US006692235B2

(12) United States Patent
Kolodziej et al.

(10) Patent No.: US 6,692,235 B2
(45) Date of Patent: Feb. 17, 2004

(54) AIR COOLED PACKAGED MULTI-STAGE CENTRIFUGAL COMPRESSOR SYSTEM

(75) Inventors: Robert M. Kolodziej, Varysburg, NY (US); Edward S. Czechowski, Orchard Park, NY (US); Donald E. Miller, Jr., Depew, NY (US); John R. Battershell, Hamburg, NY (US); Michael Thompson, West Seneca, NY (US); John C. Bartos, Williamsville, NY (US); Frank Athearn, Orchard Park, NY (US); Robert Rajeski, Williamsville, NY (US)

(73) Assignee: Cooper Cameron Corporation, Houston, TX (US)

( * ) Notice: Subject to any disclaimer, the term of this patent is extended or adjusted under 35 U.S.C. 154(b) by 0 days.

(21) Appl. No.: 09/918,119

(22) Filed: Jul. 30, 2001

(65) Prior Publication Data

US 2003/0021701 A1 Jan. 30, 2003

(51) Int. Cl.[7] ..... F04B 23/00; F04B 25/00
(52) U.S. Cl. ..... 417/243; 417/244; 417/313
(58) Field of Search ..... 417/243, 244, 417/313; 165/151

(56) References Cited

U.S. PATENT DOCUMENTS 3,644,054 A * 2/1972 Pilarczyk ..... 165/47
3,736,074 A * 5/1973 Kilbane et al. ..... 181/205
3,907,032 A * 9/1975 DeGroote et al. ..... 165/143
4,311,439 A * 1/1982 Stofen ..... 417/313
4,618,310 A * 10/1986 Michelson ..... 415/1
4,635,712 A * 1/1987 Baker et al. ..... 165/70
5,106,270 A * 4/1992 Goettel et al. ..... 417/243
5,287,916 A * 2/1994 Miller ..... 137/195
5,386,873 A * 2/1995 Harden et al. ..... 165/140
5,718,563 A * 2/1998 Hutchinson ..... 417/32
5,795,138 A * 8/1998 Gozdawa ..... 417/243
6,221,130 B1 4/2001 Kolodziej et al. ..... 95/41

FOREIGN PATENT DOCUMENTS

SU 1687860 A * 5/1989 ..... F04B/41/02

OTHER PUBLICATIONS

Higher capacity air compressors; Processing, vol. 21, p. 61, Feb. 1975.*
Ingersoll–Rand Oil and Gas News, p. 1, Feb. 2000.*
Extra instrumentation can cut compressor operating costs . . . , Hydraulics and Pneumatics, vol. 38, p. 86, Sep. 1985.*
Quest for excellence: 1994 Plant Engineering Product of the Year Finalists, Plant Engineering, vol. 28, n15, p. 34. Nov. 1994.*
Ingersoll–Rand Web Page, Type of Air Compressors, air.irco.com/asg/air_system_info/compressortype; printed Jun. 17, 2003.*
Ingersoll–Rand Web Page, Petstar3,air.irco.com/asg/air_system_info/centrifugal/pbm/petstar3; printed Jun. 17, 2003.*

(List continued on next page.)

*Primary Examiner*—Cheryl J. Tyler
*Assistant Examiner*—Timothy Solak
(74) *Attorney, Agent, or Firm*—Michael P. Hartmann; Peter A. Bielinski

(57) ABSTRACT

An air-cooled multi-stage compression system using centrifugal compressors is disclosed. It is packaged in a comparable volume to a water-cooled unit having the same driver horsepower. The performance is comparable and opportunities for use of the waste heat are available. Existing water-cooled units can be retrofit to run in an air-cooled mode. Special applications such as combined air compression and nitrogen compression useful in air separation applications are presented. The circulating cooling air can make the unit into an air filter of its surrounding space. Cooling air is drawn through the enclosure before being forced through the coolers above. This air movement can cool compressor housings, the control panel and the drive motors mounted in the enclosure.

28 Claims, 8 Drawing Sheets

OTHER PUBLICATIONS

American Process, Inc. • 776 Juniper Street • Atlanta • GA 30308 Explanation of Pinch Technology • 2 Pages • Internet Technology Date Unknown.

Clean Dry Air, Inc. • www.cleandryair.com/approach_temperature.htm Air Compressor Cooler Apporach Temperature • 2 Pages • 2 Pages • Internet Technology Date Unknown.

Skil in Energy • www.sucrose.com/energy.html Skil in Pinch Technology • 10 Pages • Internet Technology Date Unknown.

H. Van Ormer Compressors Drive the System Hydraulics and Pneumatics Magazine Dec. 2002 pp. 43–48.

Compressed Air and Gas Handbook, 4th Edition pp 2–116 to 2–119 and 3–1 to 3–3 and 3–20 to 3–21.

50–400HP Sierra Air Compressor Line Advertisement from Ingersoll–Rand Website www.irco.com/asg/rotar/.

Cooper Turbocompressor Air Cooled Oil–Free Air Brochure dated 2001.

* cited by examiner

SPECIFIC POWER COMPARISON

AIR COOLED PACKAGED MULTI-STAGE CENTRIFUGAL COMPRESSOR SYSTEM

FIELD OF THE INVENTION

The field of this invention is air-cooled centrifugal compressor packages including some applications for their use and the waste heat generated from them.

BACKGROUND OF THE INVENTION

When users in a variety of industrial applications considered a compressed gas system there were many choices. These systems could serve as plant air systems to operate a wide variety of machine components and control devices. Depending on the pressure and volume requirements of a particular location different compression packages could be used for the application. Each system had its unique advantages and disadvantages. Generally speaking as power costs increased worldwide, a greater focus was placed on multi-stage centrifugal compression systems over positive displacement designs such as screw compressors. The reason for this was that the positive displacement machines became less efficient as they wore, in normal use. In general, the initial efficiency of centrifugal compressor packages was higher than the positive displacement counterparts and the centrifugal compressor efficiency would maintain a nearly constant level over long periods of operation. Centrifugal compressors also offered excellent part load efficiencies and eliminated sliding or rubbing parts, such as in screw compressors, which would cause efficiency loss over time.

Other advantages of centrifugal compressors are high reliability, the availability of oil-free air and ease of maintenance. Some features that made these advantages possible were: non-contact air and oil seals; stainless steel compression elements; high quality gear design using unlimited life pinion bearings; the elimination of the need for oil removal filters; elimination of need to remove wearing parts; and an accessible horizontally split gearbox for quick inspections.

In the past, multi-stage centrifugal compressor units had been sold with inter-stage water-cooling to improve efficiency of the overall system. Use of water-cooled designs involved a host of significant associated costs, especially cooling towers. It also precluded applications of water-cooled centrifugal compressor packages in locations where water was not readily available or prohibitively expensive. Some potential installations also had space constraints that made use of water-cooled centrifugal compressors impossible. Water cooled systems involving cooling towers not only had space and installation cost elements but also required substantial operating costs for things such as make up water, pumping costs, chemicals including glycol to deal with potential freezing problems. Even connection to existing closed loop chilled water systems, assuming they had the requisite capacity, involved significant piping installation expenses and some of the same incremental operating costs previously described.

Multi-stage centrifugal compressor packages have, in the past, been highly engineered to be space efficient. They have been sold as a compact package with the intercoolers below a gearbox that connects all three stages to a single drive motor. The lubrication system reservoir would be provided as a separate casting from the intercoolers and mounted alongside. FIG. 5 illustrates this layout. There the drive motor 10 is connected through a gearbox 12 to the first stage 14, the second stage 16 and the third stage 18 centrifugal compressors. Compressed gas from the first stage 14 enters cooler 20 and passes into the second stage 16 through inlet pipe 22. The second stage 16 has an outlet line 24 into cooler 26 and the third stage, which receives the cooled gas from cooler 26, has its exhaust directed to an after-cooler 28. The final discharge is through line 30 which is directed upwardly adjacent the inlet line 32 to the first stage 14. A control panel 34, which sometimes requires cooling, is at one end of the skid package as is a reservoir for the lubricating oil 36, which has its own cooler (not shown). For noise control and appearance purposes, the skid further comprised a metal paneled enclosure. It should be noted that while a water-cooled system is illustrated in FIG. 5, that Figure is not considered or labeled prior art because one aspect of the present invention is to retrofit such units to air cooled operation with a minimum of modifications. This mode of the invention will be described in more detail below.

Accordingly, with the layout of skids for multi-stage centrifugal compressor packages having gained acceptance in the industry not only for its efficient performance but also for the compactness of the package, a challenge was presented to the named inventors to create an innovative package that would be more economical to install and operate than the previous water cooled designs but would also fit a housing and have a compact size, such as a comparable footprint, for a given driver horsepower. The present invention provides air-cooling as an option on a multi-stage centrifugal compressor package with no significant performance penalty. The present invention is packaged as a unit in a comparably sized enclosure having a footprint not larger than a water-cooled unit having the same driver horsepower. It does not require the space or expense of a cooling tower. The present invention captures the exhaust heat from air-cooling in a variety of ways. The present invention permits optimization of performance and power consumption in an air-cooled environment by matching the cooling capacity to the produced output. Specialized packages can be created for particular applications such as the air separation industry where there is a need for compressed air as well as compressed nitrogen from a single package. The unit can be used to filter the room air in the environment in which it is installed. It can be a retrofit of existing water-cooled units, such as shown in FIG. 5, into an air-cooled system with minimal piping modifications and elimination of the previously necessary cooling tower, if it was exclusively dedicated to cooling duty for the centrifugal compressor package.

In the past, exhaust gas from a second stage water-cooled unit has been used to regenerate air dryers filled with desiccant. This technique is illustrated in U.S. Pat. No. 6,221,130. There were positive displacement compressor packages offered with an air-cooling feature. However, in the realm of centrifugal multi-stage compressor packages, there have never been air-cooled commercial units available. The industry, as well as the end user customers, were convinced that an air-cooled centrifugal multi-stage package could not deliver the efficiency of the known water-cooled designs. The inventors, facing this prejudice, were forced to present technical data from testing such an air-cooled unit to potential customers. Data that is not normally part of ordinary commercial transactions in water cooled designs, such as FIG. 7, had to be given to potential customers to persuade them that the promised results were indeed achievable. Competitors, who offered positive displacement air-cooled units, had failed to seize upon a vast market that had gone un-served for so many years. After rollout of the air-cooled package, the customer response has been unprecedented and there is now interest from competitors to develop competing products.

Part of the difficulty in accomplishing the objective of an air cooled multi-stage centrifugal compressor unit of comparable performance to a water cooled design was to be able to package the entire system in a comparable volume while getting comparable performance. Tube/fin air-to-air exchangers were tested. While such units were operative, they didn't match the cooling performance of the counterpart water-cooled systems then commercially available. They also occupied significantly more space than the water cooled counterparts. The inventors were encouraged by these results and proceeded to further optimize the performance and compactness of the assembly. What resulted was the matching up of the plate fin air cooler type to the multi-stage compressor package in a confined volume. This combination rendered comparable performance to a water cooled unit of identical size while keeping the package size comparable. This became the optimal design for commercial use. These and other features of the present invention will be more readily understood from a review of the preferred embodiment, which appears below.

SUMMARY OF THE INVENTION

An air-cooled multi-stage compression system using centrifugal compressors is disclosed. It is packaged in a comparable volume and using the same footprint as a water-cooled unit having the same driver horsepower. The performance is comparable and opportunities for use of the waste heat are available. Existing water-cooled units can be retrofit to run in an air-cooled mode. Special applications such as combined air compression and nitrogen compression, useful in air separation applications, are presented. The circulating cooling air can make the unit into an air filter of its surrounding space. Cooling air is drawn through the enclosure before being forced through the coolers above. This air movement can cool compressor housings, the control panel and the drive motors mounted in the enclosure.

DETAILED DESCRIPTION OF THE PREFERRED EMBODIMENT

Figure 1:
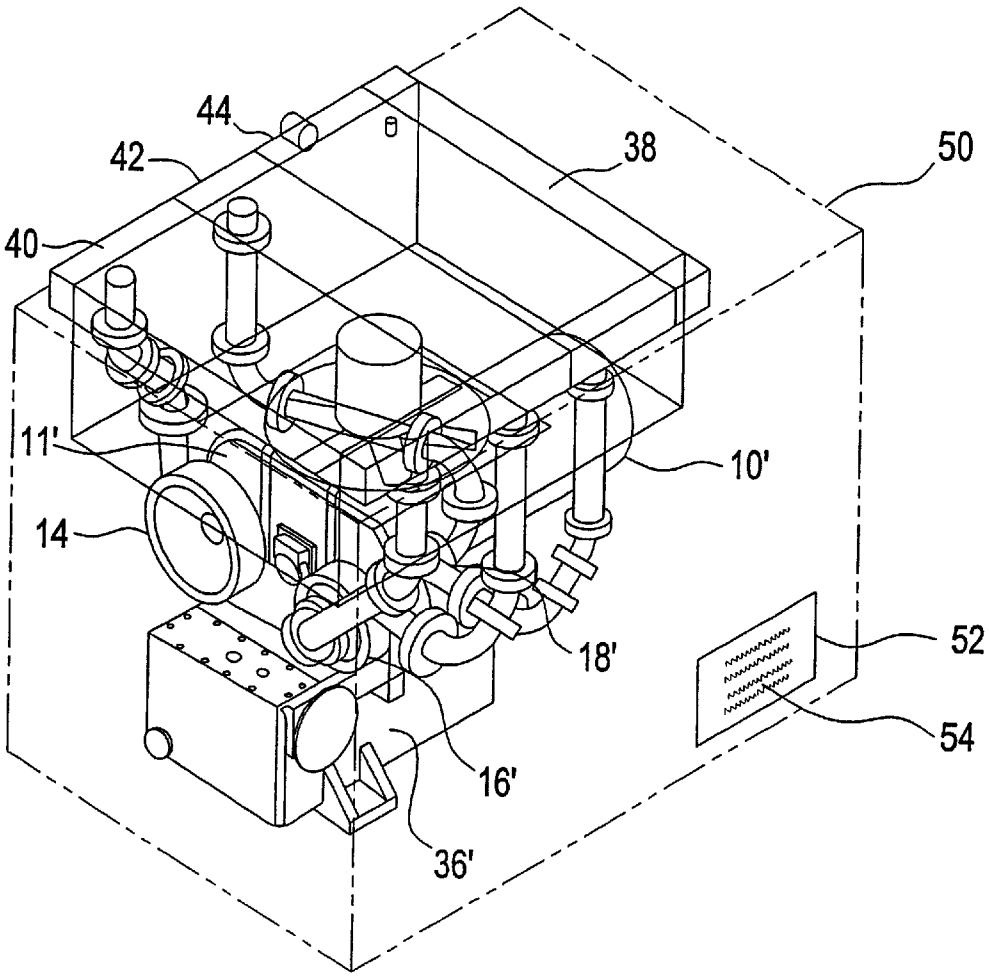
FIG. 1 is a perspective view of the air-cooled centrifugal compressor package.
Figure 2:
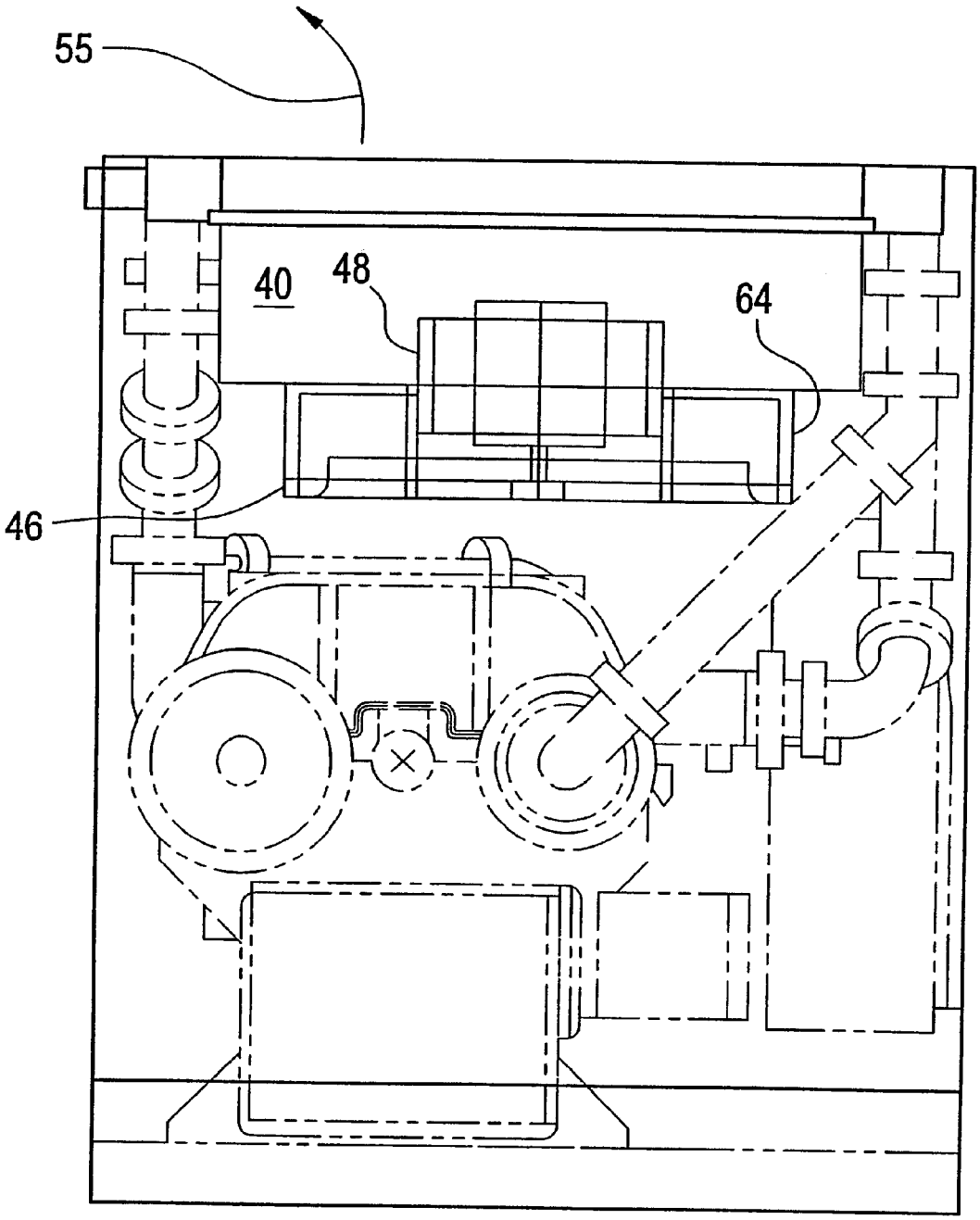
FIG. 2 is an end view of the view in FIG. 1.
Figure 3:
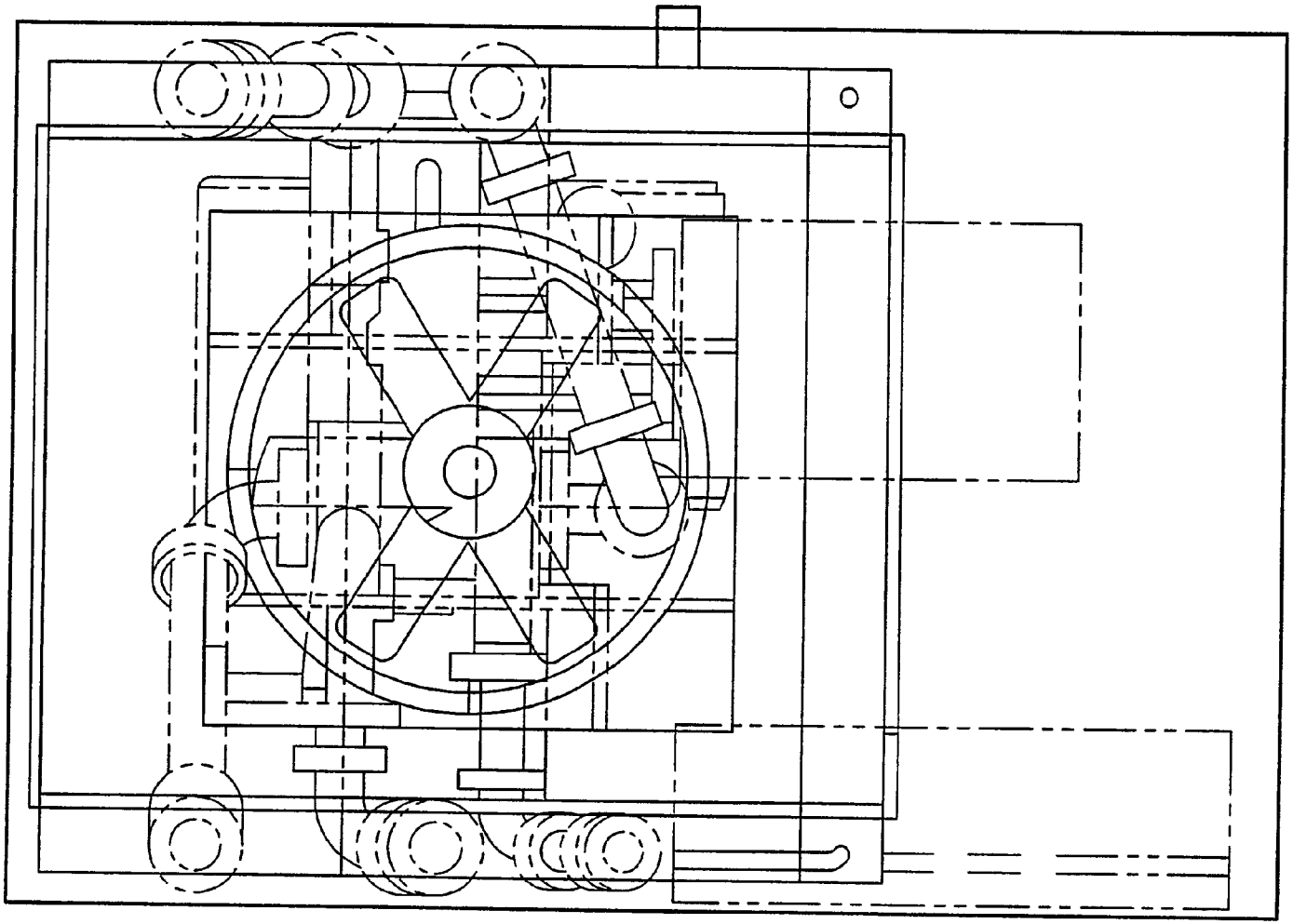
FIG. 3 is a side view of the view in FIG. 1.
Figure 4:
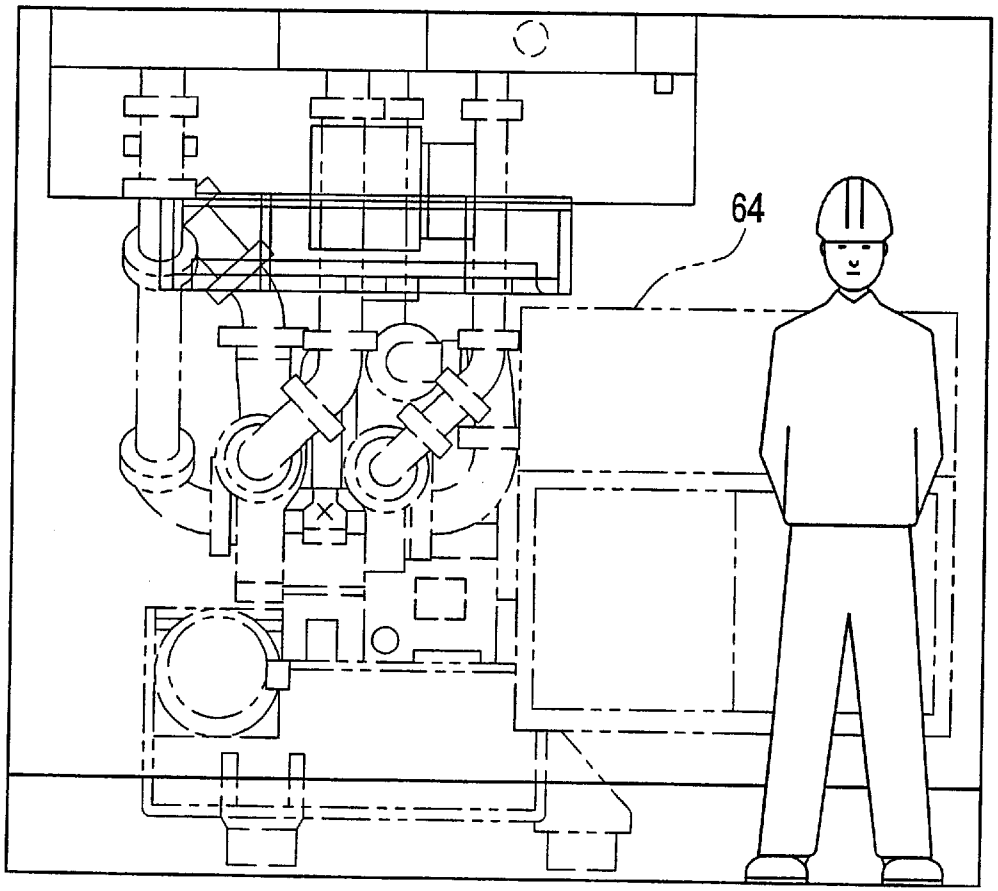
FIG. 4 is a top view of the view in FIG. 1.
Figure 5:
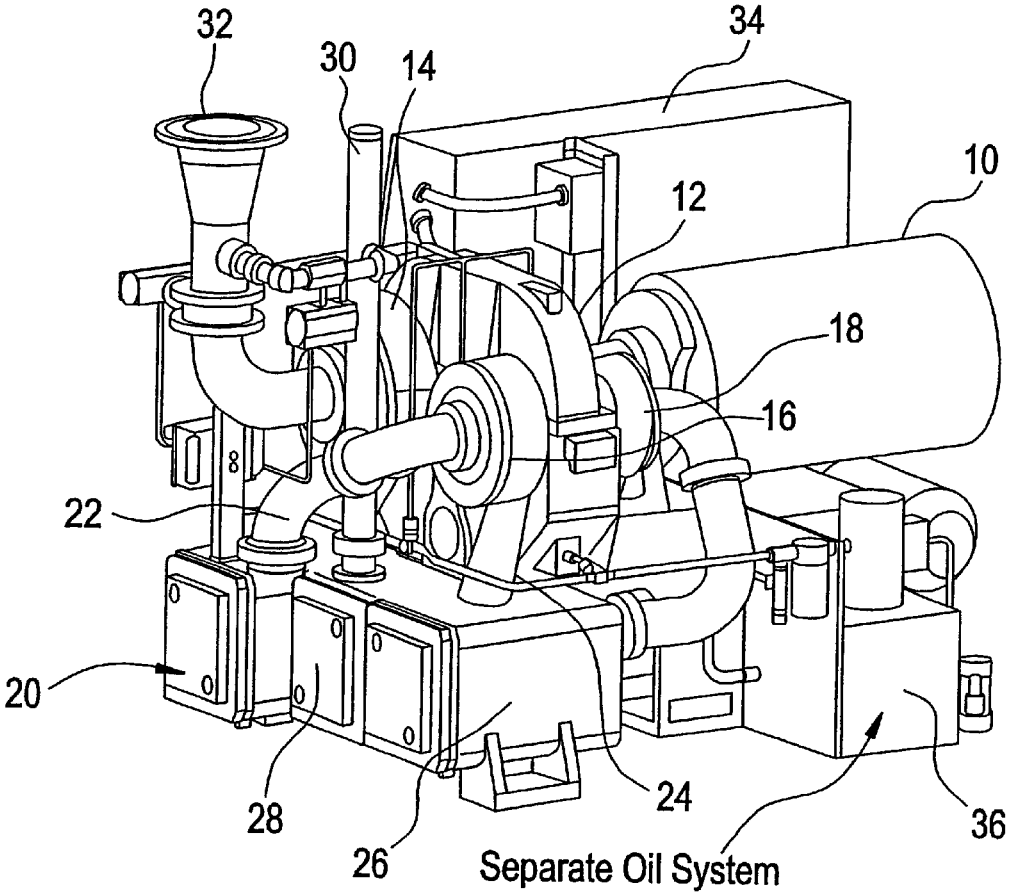
FIG. 5 PRIOR ART
FIG. 5 is a perspective view of a water-cooled centrifugal compressor package, which can be retrofitted to run in an air-cooled mode.

The preferred embodiment of the present invention is illustrated in FIG. 1. It illustrates a multi-stage centrifugal compressor unit newly designed for air-cooled operation. The differences from the previously available water-cooled designs can be more readily appreciated by comparing FIGS. 1 and 5. Again, it should be kept in mind that FIG. 5 is readily converted from water to air cooled operations with minor piping modifications, as will be described below. Comparing FIG. 1 to FIG. 5, it can be seen that the water coolers 20, 26, and 28 have been eliminated from their position below the three stage compressors 14', 16', and 18'. Instead, the lubricating oil reservoir 36' is now below the gearbox 12' and can optionally be cast as a part of it. Although not shown in FIG. 5 the separate oil cooler and its water connections have been eliminated in the FIG. 1 design by an air-to-air cooler 38. Three additional air to air coolers 40, 42, and 44 are mounted adjacent to each other in a horizontal plane to respectively cool the discharge from the three stages of centrifugal compressors 14', 16', and 18'. A fan 46 driven by electric motor 48 preferably pushes the cooling air, in parallel, through the coolers 38, 40, 42, and 44, although a pull through design could also be used. In the push through design, the air handled by the fan is denser and has the capability of removing more heat while the pull through design offers an improved airflow distribution through the coolers. The package shown in FIG. 1 is preferably housed in a louvered enclosure, shown schematically as 50. For a 350 horsepower unit the dimensions of enclosure 50 are 116" long by 73" wide by a height range of 70–90" depending on the air cooler configuration selected. The cooling air flow through the enclosure 50 is such that air enters fairly low, through louvers 52 which can optionally have filters 54 and thus can pass over the reservoir 36' as well as the three stages of centrifugal compressors 14', 16', and 18' as well as the gearbox 12'. In this way the moving cooling air cools off these pieces of equipment as it is drawn by the fan 46. The cooling airflow also passes over the motor 48 for the fan 46 as well as the main drive motor 10'. Use of the filters 54 allows the entire unit to act as an air filter in the location where it is mounted. Thus with a fan 46 delivering 18,000 SCFM and the unit mounted in a room having a height of 27 feet and 40,000 square feet of floor space, the entire space can be filtered by the unit in about 1 hour. Additionally the filters 54 pre-filter the air to be compressed. While the compressor first stage inlet has its own filter (not shown) its life is prolonged because the air has been pre-filtered by filter 54. Another advantage of filter 54 is to keep dirt in the air sucked into the enclosure 50 from coating the compressors inside and/or fouling the cooler cores. The heated cooling air exhausted from the coolers, shown schematically as arrows 55, can be used directly to heat a building in which the unit is mounted with a minimal amount or even no ductwork. The heated air 55 can be used in other energy saving ways such as supplying heated combustion air to boilers.

While the stage temperature after cooling by air can vary, performance tests on a Cooper Turbocompressor unit TA-2000 with a 350 HP driver is shown below. The first stage 14' increased the pressure from 14.03 PSIA to 26.89 PSIA with a discharge temperature of 306.6 degrees F. Prior to entry into the second stage 16' the air was cooled to 81.8 degrees F. at a pressure of 25.78 PSIA. It was then compressed to 72.1 PSIA at 260.5 degrees F. and cooled by cooler 42 to 90.3 degrees F. In the third stage it was compressed up to 123.8 PSIA at 189.5 degrees F. and cooled by cooler 44 to 78.7 degrees F. The average cooling air inlet temperature was 75.7 degrees F. measured between the fan 46 and the coolers 40, 42 and 44. This made the realized approach in the discharge from the three stages respectively 6.1, 14.6 and 3.0 degrees F. Oil passing through cooler 38 was cooled from 137.4 degrees F. to 88.5 degrees F. for an approach of 12.8 degrees. During the performance test the unit delivered 1500 SCFM of compressed air and consumed 386 amperes. The ambient conditions were 67.3 degrees F. dry bulb with a relative humidity of 27.9%.

Those skilled in the art will recognize that the capacity of fan 46 can be altered by speed control or blade pitch control or by selective air pathway obstruction of the coolers 38, 40, 42, and 44 so that in colder weather or at times where less output is required of the unit the level of cooling provided can match the requirements of the system. Doing this also saves operating costs for the fan motor 48. Alternatively, in times of light load, the motor 48 may be cycled on and off. A control system to do this can be placed in the panel 64.

By mounting the coolers in a common horizontal plane or in parallel planes, instead of stacking the coolers one above the other, the cooling is done more efficiently. The coolest air is input to each cooler and the motive horsepower for the fan 46 can be reduced as the parallel flow through the various coolers from the fan 46 offers less resistance to flow.

Figure 6:
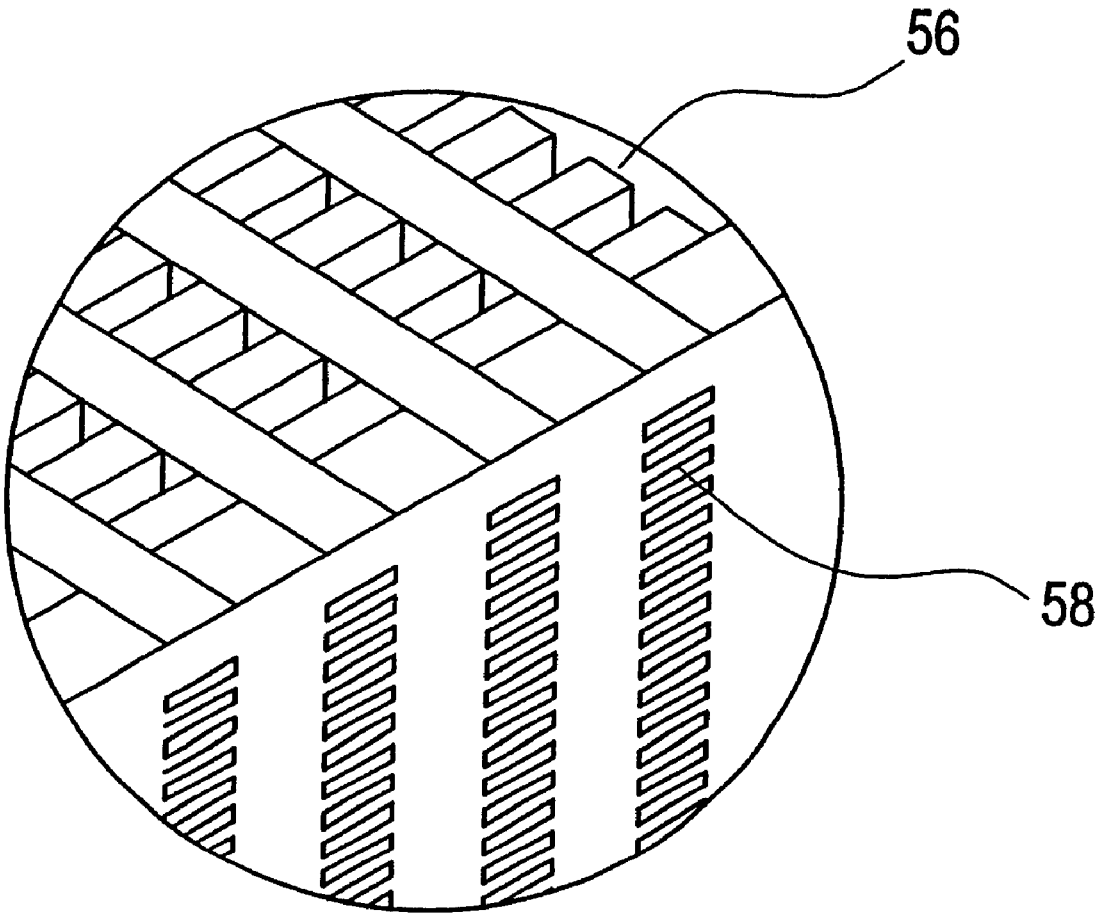
FIG. 6 is a perspective view of a part of the air-to-air heat exchanger used in the present invention.
Figure 8:
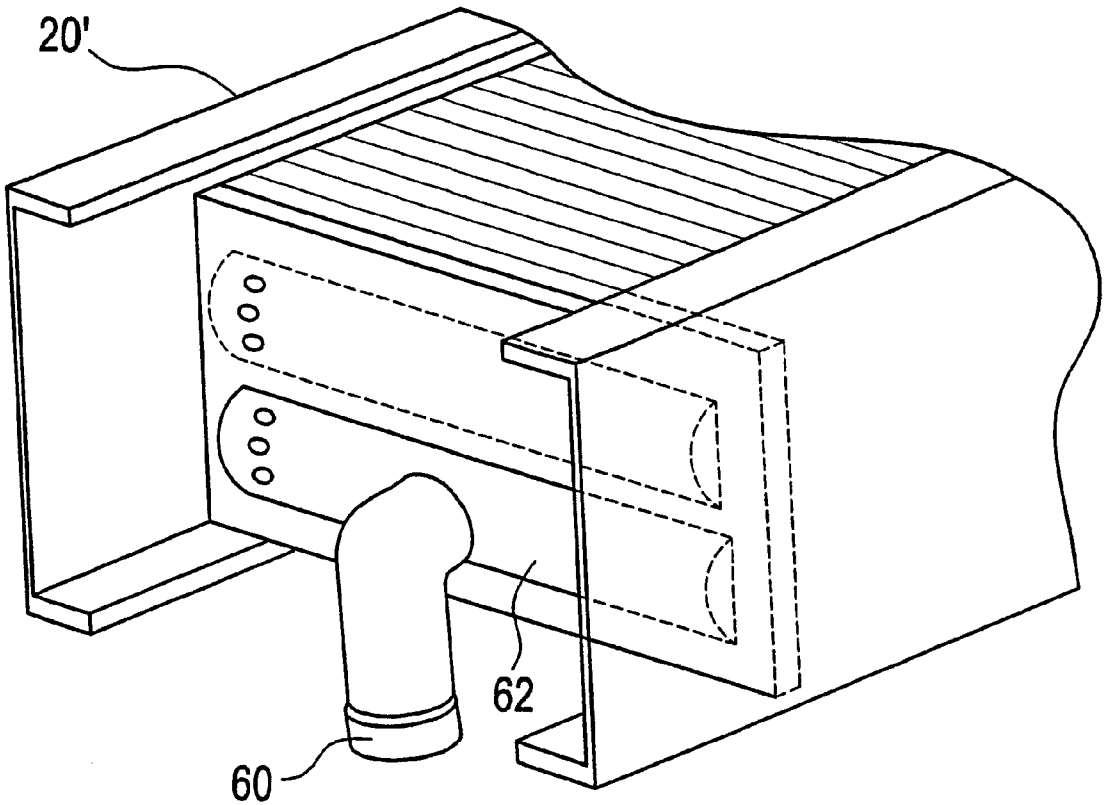
FIG. 8 is a perspective view of the end manifolds for a two pass air-to-air tube/fin cooler.

FIGS. 6 and 8 show the details of a typical cooler such as 20'. The coolers are preferably made of a modular system using vacuum brazing technology. The cooling air passes vertically through passages 56 and the compressed air makes one pass horizontally through passages 58. FIG. 8 shows a two-pass tube/fin arrangement in more detail. The one pass plate fin design is preferred for a reduced pressure drop and increased performance. An inlet 60 is connected to an inlet header 62 so as to accommodate a u-shaped path for the compressed air to be cooled, if using a two pass cooler. The cooled air outlet for two passes would then be on the same end of the cooler as the inlet 60. Alternatively, one pass for the cooled air or more than two passes could be used. The more passes the larger the size of the cooler and potentially the greater the pressure drop of the compressed air through any stage cooler. Generally oversize piping and large radius elbows are preferred to minimize pressure drop and save power. This type of exchanger, which is also known as plate-fin, can give the required cooling with pressure drops per stage of less than 1 PSI, with approach temperatures of the cooled air to ambient of less than 15 degrees and as low as less than 3 degrees. The modular components for such coolers are commercially available from API Airtech Icorporated of Arcade N.Y. U.S.A. under product designations 699-0307 through 699-0310, respectively for coolers 40, 42, 44, and 38.

Changes in the casting as between the FIG. 5 layout and the FIG. 1 layout can be done to further reduce pressure drop by elimination of unnecessary bends. For example the first stage outlet is rotated to look up in FIG. 1 from looking down in FIG. 5 so that the piping can go directly to the air cooler immediately above. To better control noise, the enclosure 50 can have sound baffles. The fan 46 also has a shroud 64 to improve performance and minimize noise.

It is worth noting that the inventors' experimental attempts to cool multi-stage centrifugal compressors with finned tube air-to-air exchangers were operational. However, the inventors saw a need for further optimization to enhance cooling performance while decreasing the package size. These efforts resulted in improvements including vacuum brazed plate-fin exchangers, parallel flow systems with a fan that pushed air through rather than pulled air through, and a cooling air flow path that cooled compressor components. This design was deemed an optimum which would most successfully compete with existing water cooled units. This conclusion was reached despite indications from those skilled in the art that pushing the air through the coolers would result in non-uniform flow through the coolers. The use of air cooling coupled with optimization of the package size allows, for the first time, a concept of portable and efficient multi-stage centrifugal compressor unit to be wheeled in, piped to an existing system and started (if it is engine driven). Alternatively, it can be hooked up electrically to the power grid at the location if it is driven by an electric motor. The newly designed system shown in FIG. 1 can occupy an equal or lesser footprint than the identically outfitted unit with water-cooling, such as depicted in FIG. 5. The FIG. 5 unit can be retrofitted by removing the tube cores out of coolers 20, 26, 28 and still directing the discharge from each stage through the now hollow cooler chambers. The outlet of each chamber would be redirected to an air cooler mounted above in the same configuration shown in FIG. 1. The cooling fan 46 is added and the operation commences on an air-cooled basis. The retrofit is fairly straightforward and, when completed, allows the disconnection of the water-cooling system equipment and the immediate savings of space and operating costs of air-cooled systems, previously described. Air-cooling affords other efficiency advantages. The airflow drawn through the enclosure 50 cools the control panel electrical components saving the installation of a panel cooler in panel 64. The same airflow over the compressors can cool them as well as the gas in the interconnecting piping. The compressor housings and the interconnecting piping can have finned exposed areas for greater heat transfer.

The use of modular sections of plate-fin air to air exchangers allows reduction of cooler approach temperatures and makes air cooling possible in high altitudes and ambient temperature applications above 105 degrees F. Water is frequently scarce in such hot environments making the present invention an economical first choice and in some cases giving an option, where no economically feasible centrifugal compression option previously existed.

For special applications, such as in the air separation business, a nitrogen booster can be piped as one of the compressors on the unit. In that manner, the relatively low pressure for compressed air requirements in air separation can be met while providing a nitrogen booster in the same air-cooled package. Additional capacity for existing water-cooling systems is not required. The final layout closely resembles that shown in FIG. 1.

Figure 7:
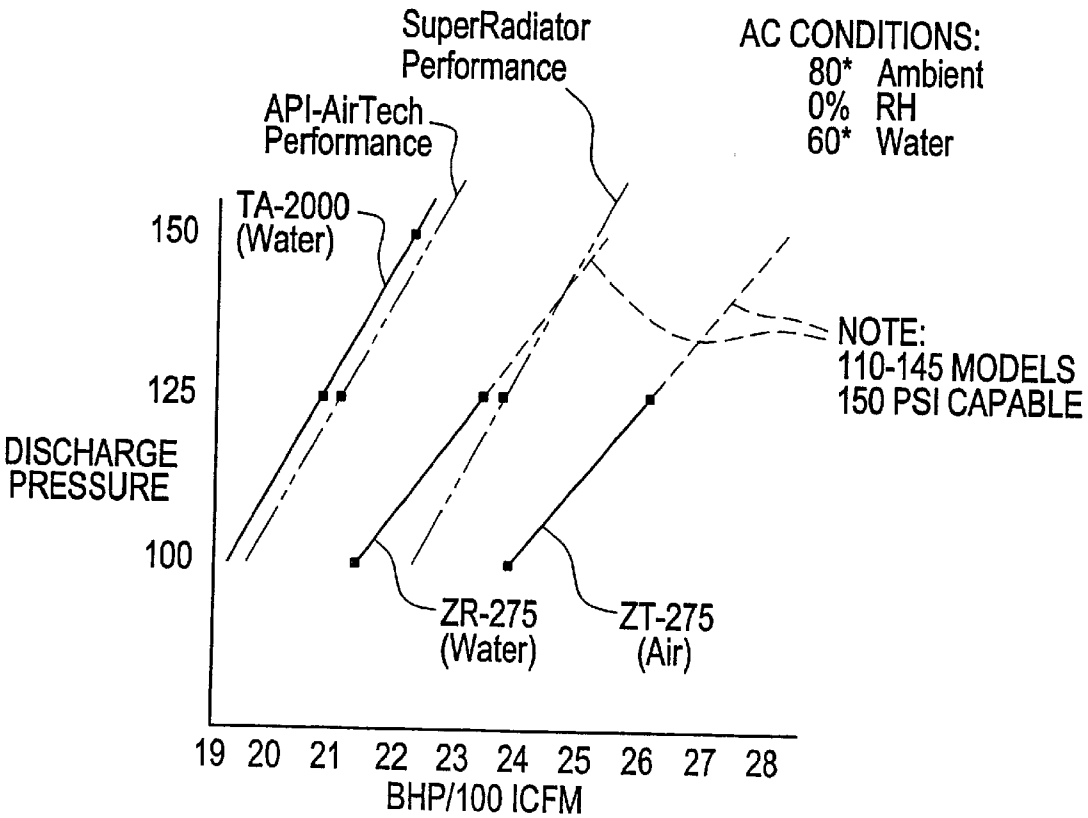
FIG. 7 is a chart showing comparable efficiency using air or water-cooling for a centrifugal compressor package and comparing that performance to an air or water-cooled positive displacement unit of comparable size.

Those skilled in the art will appreciate that the combination of an efficient multi-stage centrifugal compression system with air cooling opens new markets where water cooled units could not operate for reasons of lack of water, higher operating cost, or physical space requirements. Offshore platforms are a good example of applications with limit space availability. The air cooled design of the present invention uses the same or smaller foot print and requires no auxiliary space for the water cooling equipment such as circulating pumps. It should be noted that there was considerable doubt by end users that comparable performance could be obtained with an air-cooled unit. So much so that significantly more data about system parameters had to be released than compared to selling a water-cooled application in order to convince the end users of the viability of the concept. Graphs such as FIG. 7 were part of such disclosures.

The coolers are a modular design of a plate fin heat exchanger, using, in the preferred embodiment a single pass for the compressed gas to minimize pressure drop between stages and after the last stage. While a particular installation having 3 stages has been described, other installations with fewer or greater numbers of stages could be employed without departing from the invention. Although a single fan 46 is illustrated, multiple cooling fans are also within the scope of the invention. As an added benefit of the system shown in FIG. 1, the air drawn into the enclosure 50 cools the compressor housings and associated piping. As a result the inlet air temperature to the intercoolers, after-cooler, and oil cooler is somewhat higher than ambient. The cooling capacity can be regulated to produce a desired temperature between the stages for the compressed air. If the compressed air is being used to dry desiccant in an air dryer, the desired drying temperature can be achieved for the requisite drying time by regulation of the cooling capacity after one or more stages, which can be accomplished in the various ways previously described. The ability to package air-cooling with multi-stage centrifugal compressors opens up a previously un-served market for portable units. Custom units such as for air separation plants are possible even if existing cooling tower systems or chilled water systems have no remaining capacity. Additionally existing water cooled units can be quickly retrofitted by removing cooler cores and redirecting flow through the hollow former water cooler housings into an air cooler mounted above. The water-cooled unit of FIG. 5 can easily run as an air cooled unit having the same footprint. Many additional savings in operating costs and space for the water-cooling equipment can be realized after the retrofit conversion.

It is to be understood that this disclosure is merely illustrative of the presently preferred embodiments of the invention and that no limitations are intended other than as described in the appended claims

We claim:

1. A method of gas compression, comprising:

providing a plurality of centrifugal gas compressors arranged in series for stepwise gas compression;

mounting said compressors on a frame for portability;

supporting a plurality of air coolers from said frame;

connecting said coolers to at least one of the discharges of said compressors to allow the compressed gas to be cooled therein; and providing an air mover supported from said frame to force cooling air through said air coolers for air cooling the compressed gas to get the discharge temperature of the gas after said stepwise gas compression to an approach temperature of within the range of about fifty to three degrees Fahrenheit of the surrounding ambient temperature.

2. The method of claim 1, comprising:

discharging said cooling air vertically.

3. The method of claim 1, comprising:

supporting said compressors, said plurality of air coolers and said air mover on said frame for water cooling operation within a footprint that is no larger in square feet than a frame which would support said same compressors equipped instead with a plurality of liquid coolers and operating in water cooled operation.

4. The method of claim 1, comprising:

providing at least one fan as said air mover;

using air moved by said fan through said air coolers to cool said compressors by passing the air around them before the air enters said air coolers.

5. The method of claim 1, comprising:

providing at least one fan as said air mover and an associated filter;

filtering the air passing through said air coolers.

6. The method of claim 1, comprising:

providing at least one fan as said air mover;

using a control system to vary the cooling capacity of the combination of said fan and said air coolers to hold a pre-selected temperature of the compressed gas at a pre-selected location.

7. The method of claim 6, comprising:

using said controller to regulate the operation of said fan.

8. The method of claim 1, comprising:

providing at least one fan as said air mover;

warming said cooling air by passing it through said air coolers;

moving said warmed air by said fan to another device for use of the energy in said warmed air therein.

9. The method of claim 1, comprising:

circulating lubricating oil to said compressors and through an oil cooler;

providing at least one fan said gas mover;

moving cooling air with said fan to said oil cooler as well as said plurality of air coolers.

10. The method of claim 9, comprising:

mounting said plurality of air coolers and said oil cooler adjacent to each other and in a common substantially horizontal plane above said compressors for parallel flow from said fan moving cooling air therethrough.

11. The method of claim 1, comprising:

mounting a plurality of liquid coolers comprising a housing and a removable tubing bundle to the discharge of a plurality of said compressors;

removing said bundles from said housings of said liquid coolers;

directing compressed gas through said housings to said plurality of air coolers that are fed by said air mover.

12. The method of claim 11, comprising:

using a frame having a footprint no larger than that used to operate said compressors in a water cooled mode after conversion of said compressors to an air cooled mode and flowing the compressed gas through said housings of said liquid coolers.

13. The method of claim 11, comprising:

providing a water cooled oil cooler as part of a lubrication system for said compressors;

providing at least three compressors and at least three liquid coolers with one liquid cooler mounted to the discharge of each of said compressors;

supplying cooling air to at least four coolers mounted above said compressors using said air mover to assume the cooling task previously handled by said oil cooler and said liquid coolers;

routing compressed gas from each stage of compression through a liquid cooler housing with its tube bundle removed to an air cooler.

14. The method of claim 1, comprising:

compressing nitrogen with at least one of said compressors while at least one other compressor compresses gas;

supplying said plurality of air coolers with said air mover; and mounting said air coolers over said compressors.

15. The method of claim 1, comprising:

providing at least three compressors;

providing at least four air coolers and at least one fan;

surrounding said compressors, air coolers and fan with a housing;

drawing air through said housing and over said compressors with said fan prior to pushing cooling air in parallel through said air coolers, one of which cools lubricating oil for said compressors.

16. The method of claim 15, comprising:

driving said compressors with an electric motor.

17. The method of claim 1, comprising:

providing a common gearbox, having a lubricating oil reservoir;

driving said compressors with said gearbox.

18. The method of claim 1, comprising:

providing an air cooler after each stage of compression that brings the discharge approach temperature of the compressed gas after all compression to a range between about ten to three degrees Fahrenheit of ambient temperature.

19. The method of claim 1, comprising:

powering said air mover separately from said compressors.

20. A method of gas compression, comprising:

arranging a plurality of centrifugal gas compressors in series for stepwise gas compression on a frame for portability;

mounting a plurality of plate-fin coolers on said frame;

mounting said coolers to at least one of the discharges of said compressors to allow the compressed gas to be cooled therein; and providing an air mover supported from said frame;

forcing cooling air through said coolers for air cooling the compressed gas from at least one of said compressors to get the discharge temperature of the gas after said stepwise gas compression to an approach temperature range of about 55 to three degrees Fahrenheit of the surrounding ambient temperature.

21. The method of claim 20, comprising:

producing said air coolers by a vacuum brazing technique.

22. The method of claim 21, comprising:

providing at least three compressors and at least three coolers with one air cooler positioned after the discharge of each of said compressors:

providing at least one fan as said gas mover;

mounting said air coolers over said compressors within a footprint occupied by said compressors;

forcing air in parallel through said at least three air coolers with said fan.

23. The method of claim 22, comprising:

providing a lubricating oil system further comprising an oil cooler on said frame for said compressors;

mounting said at least air three coolers and said oil cooler above said compressors such that said fan can push cooling air in parallel though said air coolers.

24. The method of claim 20, comprising:

forcing said compressed gas and said cooling gas to make a single pass through said air coolers.

25. The method of claim 24, comprising:

mounting said fan after said air coolers to pull air through said air coolers.

26. The method of claim 20, comprising:

mounting said air coolers substantially horizontally above said compressors.

27. A method of gas compression comprising:

mounting a plurality of centrifugal gas compressors arranged in series for stepwise gas compression on a frame for portability;

mounting a plurality of coolers supported on said frame;

connecting said coolers to at least one of the discharges of said compressors to allow the compressed gas to be cooled therein; and providing an air mover supported from said frame;

forcing cooling air through said coolers for air cooling the compressed gas from at least one of said compressors to get the discharge temperature of the gas after said stepwise gas compression to an approach temperature range of about 55 to three degrees Fahrenheit of the surrounding ambient temperature;

cooling said compressors with said fan by passing the air around them before the air enters said coolers;

mounting said fan before said coolers to push air through said coolers.

28. The method of claim 27, comprising:

mounting an air cooler after each stage of compression;

bringing the discharge approach temperature of the compressed gas after all compression to a range between about 15 and three degrees Fahrenheit of ambient temperature.

* * * * *